United States Patent [19]

Baer

[11] 4,110,502

[45] Aug. 29, 1978

[54] LABELING

[75] Inventor: James Baer, Aurora, Oreg.

[73] Assignee: Pay Less Drug Stores Northwest, Inc., Beaverton, Oreg.

[21] Appl. No.: 818,159

[22] Filed: Jul. 22, 1977

Related U.S. Application Data

[63] Continuation of Ser. No. 601,546, Aug. 4, 1975, abandoned, which is a continuation-in-part of Ser. No. 568,842, Apr. 17, 1975, abandoned.

[51] Int. Cl.[2] ..... G09F 3/00

[52] U.S. Cl. ..... 428/40; 40/2 R; 428/41; 428/80; 428/81; 428/121; 428/124; 428/137

[58] Field of Search ..... 428/40, 41, 42, 43, 428/121, 124, 126, 130, 137, 80, 81; 40/2 R, 21 R

[56] References Cited

U.S. PATENT DOCUMENTS

| | | | |
|---|---|---|---|
| 3,737,364 | 6/1973 | Heindl, Jr. | 428/42 |
| 3,820,261 | 6/1974 | Beall, Jr. | 40/2 R |
| 3,920,122 | 11/1975 | Koehlinger et al. | 428/43 |
| 3,924,744 | 12/1975 | Heimann | 206/820 |
| 3,993,814 | 11/1976 | Cavender | 428/40 |

OTHER PUBLICATIONS

Kimball, "Able-Stik Pinfeed Labels", pp. 1-8, pub. by Litton Business Systems, Inc. (1973).

*Primary Examiner*—William J. Van Balen

*Attorney, Agent, or Firm*—Klarquist, Sparkman, Campbell, Leigh, Hall & Whinston

[57] ABSTRACT

A computer carrier strip having perforated feed is slit longitudinally and a label price tag strip having a gummed back is adhered to the computer strip, after which the strips are perforated to form tear lines, and cutouts are made to make a composite strip form carrying T-shaped label-price tag sheets connected together by perforated tear lines only at the tops and bottoms of the labels and with the price tag portions separated by the cutouts and connected to the labels only by perforated tear or fold lines superimposed along the slit along the computer strip. A computer prints the names, addresses, contents of shipping cartons on the labels and prices on the price tags. Then, when a carton having merchandise therein is to be shipped, the label for that carton is peeled from the backing strip and carries with it the price tag portion and the portion of the backing strip under the price tag portion. The price tag portion, with its backing strip portion, is folded back under the central portion of the label leaving adhesive upper and lower portions which are pressed against the carton. Then, when the carton reaches its destination and is opened, the user tears the label, with the price tags and backing strip portion from the carton, and removes the gummed price tags as needed. Other computer strips have the labels slit completely from each other, and in one of these computer strips, each label has one corner cut out to facilitate peeling the adjacent label.

16 Claims, 10 Drawing Figures

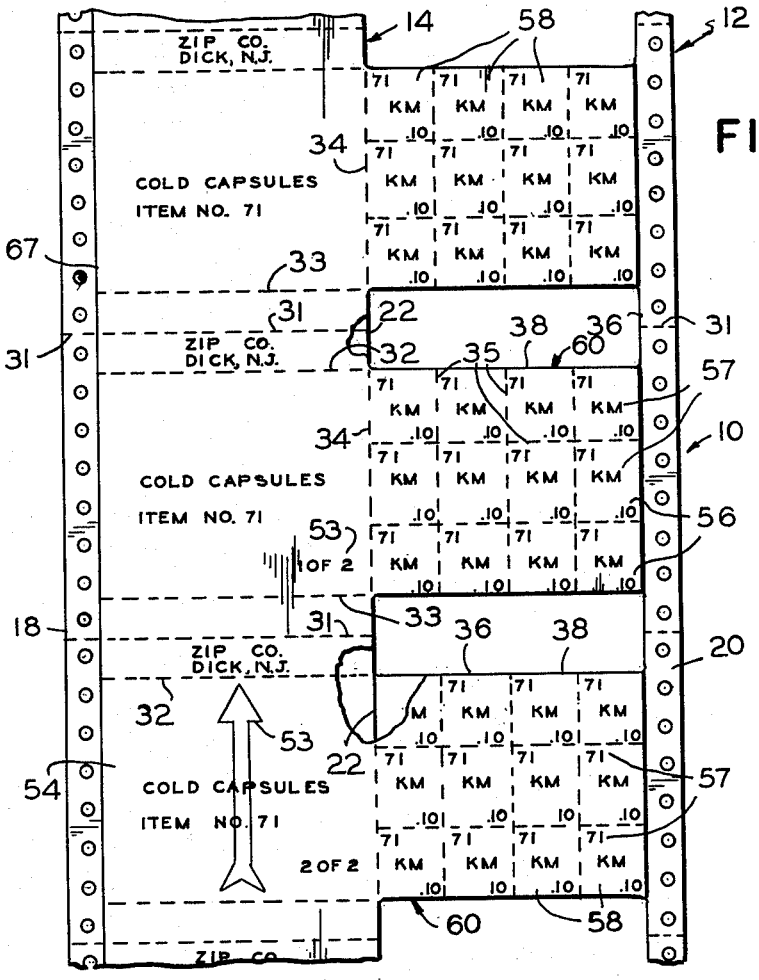
FIG. 1
FIG. 3
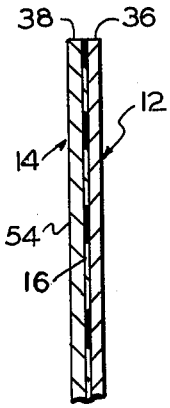
FIG. 2
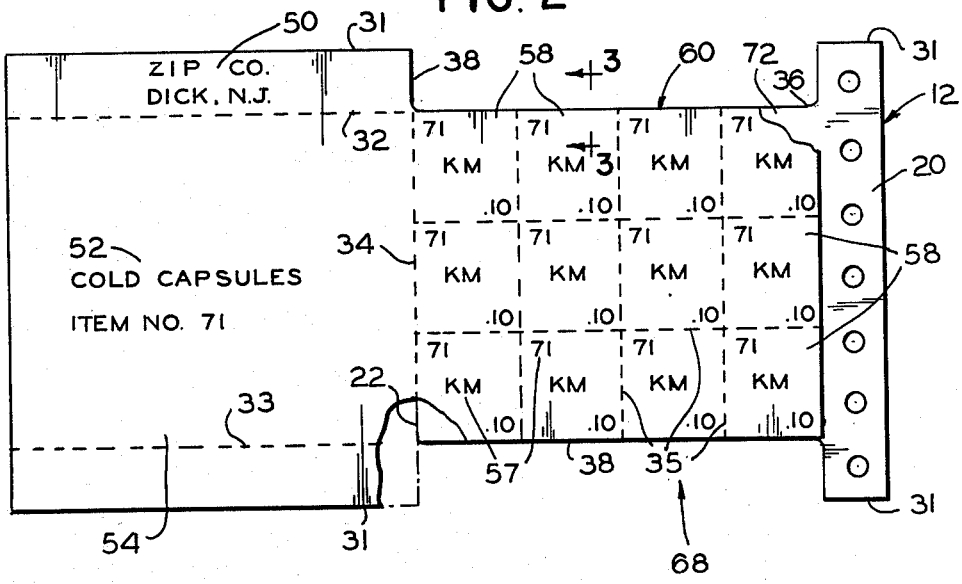

FIG. 9
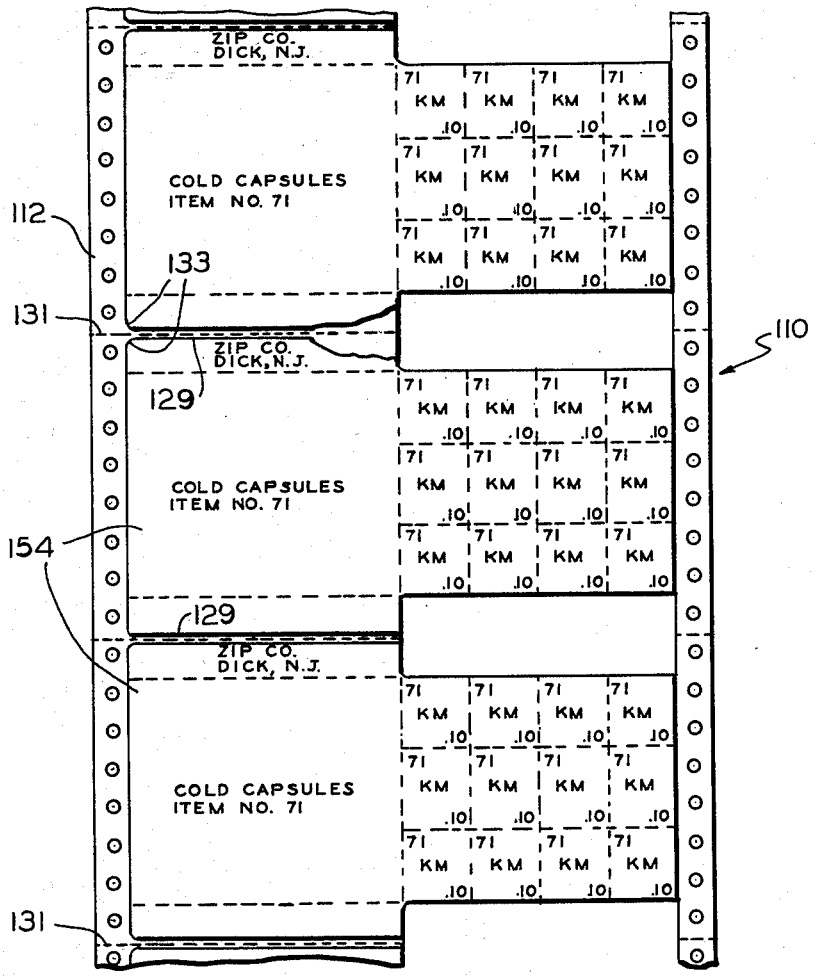
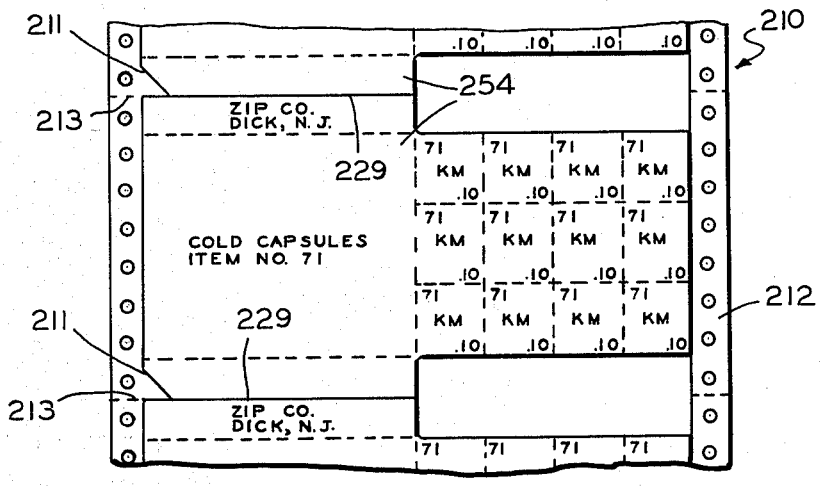
FIG. 10

LABELING

This is a continuation of application Ser. No. 601,546, filed Aug. 4, 1975, which is a continuation-in-part of application Ser. No. 568,842, filed Apr. 17, 1975, both abandoned.

DESCRIPTION

This invention relates to improved labeling, and has for an object thereof the provision of new and improved labeling.

Another object of the invention is to provide a label-price tag sheet wherein a price tag portion is folded under only a part of a label portion which has adhesive on the uncovered portion for securing the sheet to a carton.

Another object of the invention is to provide a generally T-shaped label-price tag sheet wherein a price tag portion having adhesive on the back thereof forms the narrower stem of the T and is foldable back under a wider label portion along with a separating sheet between the price tag and label portions to leave margins of the label portion which has adhesive on its back side.

A further object of the invention is to provide an improved method of making a computer strip form in which a combined backing and carrier strip is slit longitudinally, a label-price tag strip is adhered to the carrier strip to hold the two halves of the carrier strip together and perforated tear and fold lines are formed in the strips.

Another object of the invention is to provide a computer strip form including a computer carrier strip and a label-price tag strip having pressure sensitive adhesive on its back secured to the central portion of the carrier strip, and perforated and/or cut lines in the carrier strip and the label-price tag strip to permit label-price tag sheets to be peeled from the carrier strip and carrying separated portions of the carrier strip adapted to separate label and price tag portions when the price tag portions are folded back under the label portions and to leave uncovered parts of the adhesive covered backs of the labels for attaching the labels to cartons.

Another object of the invention is to provide a computer strip form having a carrier strip slit longitudinally and a label-price tag strip having pressure sensitive adhesive on its back on the carrier strip and holding the two halves of the carrier strip together, cutouts being formed in the strips from the slit toward one edge of the strips and tear perforations also being formed in the label-price tag strip to define label-price tag sheets in which wider label portions can be peeled from the carrier strip and take therewith narrower price tag portions having carrier strip portions thereunder.

In the drawings

FIG. 1 is a fragmentary, top plan view of an improved computer strip form forming one embodiment of the invention;

FIG. 2 is an enlarged top plan view of a label-price tag composite of the strip form of FIG. 1 and forming one embodiment of the invention;

FIG. 3 is an enlarged, fragmentary sectional view taken along line 3—3 of FIG. 2;

FIG. 9 is a fragmentary, top plan view of a computer strip forming an alternate embodiment of the invention; and FIG. 10 is a fragmentary, top plan view of a computer strip forming an alternate embodiment of the invention.

Figure 4:
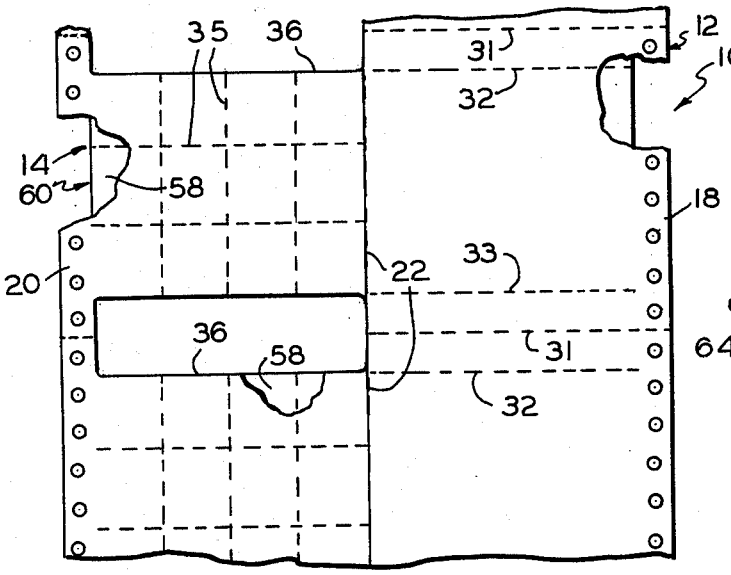
FIg. 4 is an enlarged, fragmentary, bottom plan view of the computer strip form of FIG. 1.

Referring now in detail to the drawings, there is shown in FIGS. 1 and 4 a computer strip form 10 forming one specific embodiment of the invention and including a paper carrier strip 12 and a label-price tag paper strip 14 having a pressure sensitive backing 16 thereon sticking the strip 14 to the strip 12 between perforated margins 18 and 20 of the carrier strip. In forming the strip form 10, a knife cut 22 (FIG. 4) is made along the entire length of the centerline of the carrier strip 12 after which the strip 12 is pressed against the front face of the strip 14 to adhere the two strips together, the strip 14 then holding the two halves of the longitudinally split strip 12 together. Then, perforated tear lines 31–35 are formed through the sheets 12 and 14 and rectangular cutouts or holes 36 and notches 38 are made in the strips 12 and 14, respectively, the lines 31 and 34 also being fold lines.

Figure 7:
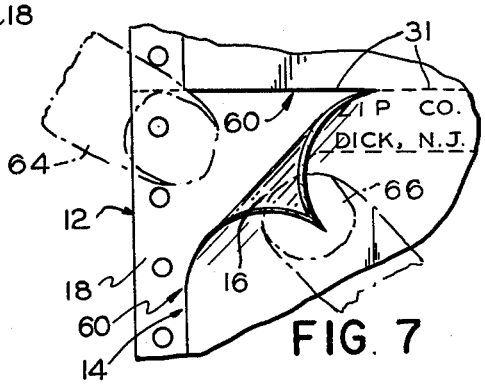
FIG. 7 is an enlarged, fragmentary, top plan view of the computer strip form with one of the label portions being peeled off the carrier strip.
Figure 5:
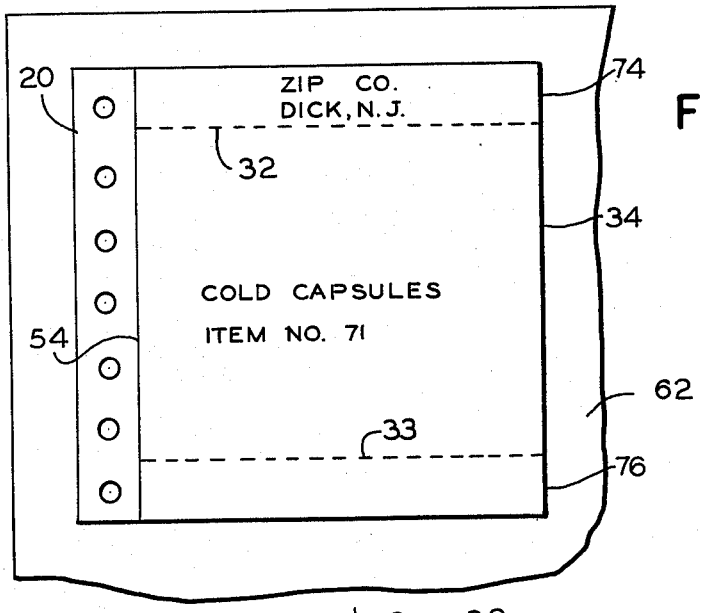
FIG. 5 is an enlarged, fragmentary top plan view of a carton having the label-price tag adhered thereto with the label portion uppermost and the price tag portion folded thereunder.
Figure 8:
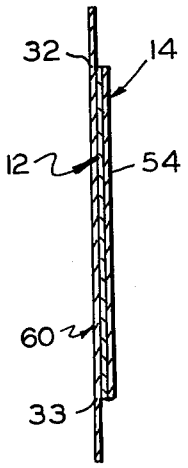
FIG. 8 is an enlarged, sectional view taken along line 8—8 of FIG. 6.
Figure 6:
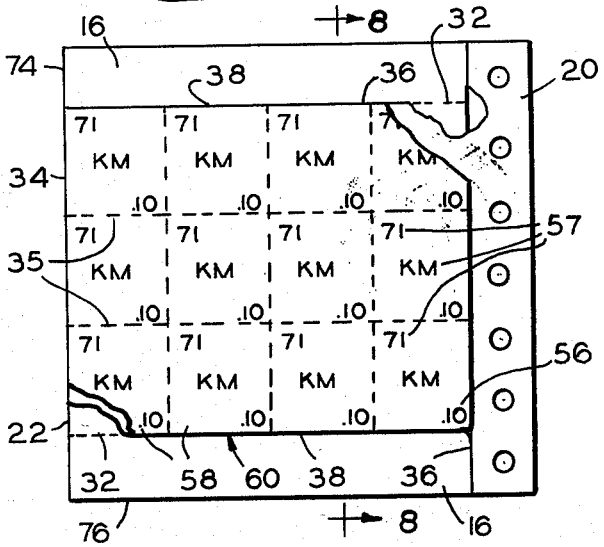
FIG. 6 is an enlarged bottom plan view of the label-price tag composite of FIG. 5.

After the strip form 10 is so formed, it folds along lines 31 into a stack, and is run through a computer (not shown) which prints names and addresses 50 and contents identification 52 and any other desired indicia 53 on label portions 54 of the strip 14. It also prints prices 56 and other desired indicia 57 on price tags 58 of price tag portions 60, which are joined to the label portions 54 by the fold lines 34. Then, the so printed out strip form is sent to a warehouse, and, when a carton 62 (FIG. 5) is to be sent to a store, the label portion 54 printed for that carton is peeled from the continuous strip half 67 of the strip 12, thumbs 64 and 66 of the user being shown in the peeling in FIG. 7, and the margin 12 is torn at the lines 31 to remove a label-price tag composite or assembly 68 as shown in FIG. 2. The composite 68 includes the label portion 54 gummed on its uncovered back with the pressure sensitive adhesive 16, the price tag portion 60 and a T-shaped segment 72 of the strip 12 adhered to and covering the gummed back of the price tag portion 60. The price tag portion then is folded back, along the line 34, under the label portion and the segment is adhered to the central portion of the label portion 54, as shown in FIGS. 5 and 6, leaving gummed upper and lower margins 74 and 76 uncovered. The composite then is placed on the carton 62 and the gummed margins are pressed against the paper carton to stick the composite to the carton, as shown in FIG. 5. Then, when the carton has arrived at its destination and is opened up, the user merely tears off the composite, tearing off the margins at tear lines 32 and 33, and peels and tears off the price tags 58 one at a time and sticks them on the goods from the carton.

While the composite 68 is on the carton, the price tags are covered and protected, and are not visible so that confidentiality of pricing is maintained. Also, the price tags are always fixed to the label portion 54 and therefore with the carton so as to be readily available whenever the carton is opened, the price tags being adhered to the segment 72 and the segment 72 being adhered to the label portion.

The faces of the carrier strip 12 are somewhat waxy so that the pressure sensitive adhesive 16, while sticking thereto, can be readily peeled off. If a carton is to have an exceptionally large number of units, more than the number of price tags on one price tag portion 60, the computer prints an arrow 80 (FIG. 1) on one or more of the immediately succeeding label portions 54 and this composite (or composites) are also torn off, the price tag portion folded back, and the label portion also stuck onto the carton.

Each composite 68 may be peeled and torn from the strip form with a single sweep. While the cutouts 36 and 38 are preferred, it will be understood that instead of the cutouts, very weak tear lines may be formed at the tops and bottoms of the cutouts 36 and 38 and complete cuts formed at the right-hand edges of the cutouts 36, as viewed in FIG. 1. However, these latter tear lines must be very weak to readily separate the composites along these lines.

Embodiment of FIG. 9

A computer strip 110 forming an alternate embodiment of the invention is like the computer strip 10 of FIGS. 1–4 except that, to facilitate folding of the strip and also the peeling of each label portion 154 from carrier strip 112, the label portions are separated by narrow cutout portions 129, which are superposed over perforated tear lines 131 in the carrier strip. Corner portions 133 of the labels are rounded. Also, as another alternative, it will be understood that the perforated lines 31 (FIGS. 2–5) may be such as to be much more easily torn than the lines 32 and 33.

Embodiment of FIG. 10

A computer strip 210 forming an alternate embodiment of the invention is like a computer strip 110 except that in the strip 210, knife cuts 229 are provided, and may have corner cutouts 211 made to enable corners 213 to be easily lifted from carrier strip 210 to start the peeling of each label portion 254 from carrier strip 212.

What is claimed is:

1. In a label-price tag composite, a shipping label having an adhesive on the back side thereof, a backing sheet adhered to the back side of the label, and a price tag sheet secured at one edge thereof to one edge of the label with a fold line formed therebetween and having an adhesive on the back side thereof, the price tag sheet being folded along said edges back under the label and the backing sheet and adhered to the backing sheet and peelable therefrom, the price tag sheet and the backing sheet covering only a portion of the back side of the label and leaving uncovered at least a portion of the back side of the label, whereby the uncovered portion of the back side of the label can be adhered to an article to be shipped , the backing sheet extending no farther under the price tag sheet than the fold line so that the price tag sheet is easily folded under the label.

2. The label-price tag composite of claim 1 wherein the uncovered portion of the back side of the label comprises at least one edge portion of the label.

3. The label-price tag composite of claim 2 wherein the uncovered portion of the back side of the label comprises at least two opposite edge portions of the label.

4. The label-price tag composite of claim 3 wherein the price tag sheet and the label are, before the price tag sheet is folded back on the label, substantially T-shaped.

5. The label-price tag composition of claim 4 wherein a backing sheet is adhered to and is carried by the price tag sheet before the price tag sheet is folded back on the label.

6. In a computer strip form construction, a non-adhesive carrier strip having a pair of perforated feed portions along the side edges thereof and a central, fully cut line paralleling the side edges to form two side-by-side backing portions, a plurality of carton labels each of a predetermined height and pressure sensitive adhesive on the back thereof adhering the label to one of the backing portions, a plurality of price tag sheets each comprising a plurality of price tags secured to each other and to the carton label along tear lines and pressure sensitive adhesive on the backs thereof adhering the sheet to the other backing portion, the tear lines between the carton labels and the price tag sheets forming fold lines, the carton labels and the price tag sheets serving to secure the backing portions of the carrier strip together, each of the price tag sheets being of a height less than that of the carton labels and being between the upper and lower edges of each carton label, the backing portion covering the back of the carton label being removable so that the price tag sheet and other backing portion can be folded back on and the other backing portion be adhered to the back of the shipping label with exposed portions of the back of the shipping label being adherable to a carton, said other backing portion being in separated segments each being under one of the price tag sheets and being of a height less than that of the carton label secured to said one of the price tag sheets.

7. The computer strip form construction of claim 6 wherein the labels are each completely separate from each other.

8. The computer strip form construction of claim 7 wherein knife cuts separate the labels from each other.

9. The computer strip form construction of claim 8 wherein each label has a corner cut out portion to facilitate peeling an adjacent label.

10. The computer strip form construction of claim 7 wherein at least portions of each pair of adjacent labels are spaced from each other.

11. The computer strip form construction of claim 10 wherein each label has a cutout corner portion.

12. The computer strip form construction of claim 10 wherein each pair of adjacent labels are spaced slightly from each other along the entire lengths thereof.

13. The label-price tag composite of claim 1 wherein the edge of the price tag sheet adjacent the label is secured to the label along a sufficient portion of the entire length of that edge that folding of the price tag sheet transversely of that edge is prevented.

14. The computer strip form construction of claim 6 wherein the edge of each price tag sheet adjacent its associated label being secured to that label along a sufficient portion of the entire length of that edge that holding of the price tag sheet transversely of that edge is prevented.

15. The computer strip form construction of claim 6 wherein said other backing portion has cutouts to define the upper and lower edges of the separated segments and position the upper edge of each segment below the upper edge of the adjacent label and the lower edge of each segment above the lower edge of the adjacent label, the cutouts leaving only the adjacent perforated feed portion intact.

16. In a computer strip form construction of a non-adhesive carrier strip having a pair of perforated feed portions along the side edges thereof and a central cut line paralleling the side edges and dividing the strip into a label portion and a price tag portion, and a label-price tag strip having a label section and a price tag section side-by-side, the label section comprising a series of labels separable from each other, the label-price tag strip having on the back thereof a pressure sensitive adhesive adhered to the carrier strip and holding the label portion and the price tag portion of the carrier strip together with the label section adhered to the label portion and the price tag section adhered to the price tag portion, the price tag section and price tag portion having cut-out portions to separate the price tag portion into a series of separated segments secured together only by one of the perforated feed portions so that when the price tag section and portion are folded back under the label section, they leave exposed at least part of the back side of each label, the edge of each price tag section adjacent its associated label section being secured to that label section along the entire length of that edge so that folding of the price tag sheet transversely of that edge is prevented, each cutout portion extending below the upper edge of the adjacent label and also extending above the lower edge of the label just above the adjacent label.

* * * * *

UNITED STATES PATENT AND TRADEMARK OFFICE

CERTIFICATE OF CORRECTION

PATENT NO. : 4,110,502

DATED : August 29, 1978

INVENTOR(S) : JAMES BAER

It is certified that error appears in the above-identified patent and that said Letters Patent are hereby corrected as shown below:

Col. 4, line 8 (claim 5, line 1), change "composition" to --composite--

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*

Notice of Adverse Decision in Interference

In Interference No. 100,328, involving Patent No. 4,110,502, J. Baer, LABELING, final judgment adverse to the patentee was rendered Jan. 22, 1981, as to claims 1, 2 and 3.

[*Official Gazette April 14, 1981.*]